United States Patent [19]

Yabe

[11] Patent Number: 4,648,250

[45] Date of Patent: Mar. 10, 1987

[54] APPARATUS FOR DYEING A WEB OF FABRIC CONTINUOUSLY

[75] Inventor: Tomoyoshi Yabe, Kawachinagano, Japan

[73] Assignee: Suminoe Textile Co., Ltd., Osaka, Japan

[21] Appl. No.: 740,774

[22] Filed: Jun. 3, 1985

[30] Foreign Application Priority Data

Jun. 15, 1984 [JP] Japan ..... 59-123957
Jun. 15, 1984 [JP] Japan ..... 59-123958

[51] Int. Cl.[4] ..... D06B 1/02
[52] U.S. Cl. ..... 68/5 D; 68/205 R
[58] Field of Search ..... 68/5 D, 5 E, 205 R

[56] References Cited

U.S. PATENT DOCUMENTS 3,271,102 9/1966 Morgan ..... 68/205 R X
4,495,783 1/1985 Sando et al. ..... 68/5 D

FOREIGN PATENT DOCUMENTS 2030183 4/1980 United Kingdom ..... 68/5 E

*Primary Examiner*—Philip R. Coe
*Attorney, Agent, or Firm*—Armstrong, Nikaido, Marmelstein & Kubovcik

[57] ABSTRACT

Apparatus for continuously dyeing a web of pile fabric is proposed which has a dry heating unit and a wet heating unit combined together, both having a pile separating roller and a set of spray guns opposed to the roller. Dye is sprayed by the spray guns into space between the piles separated by the pile separating roller.

2 Claims, 5 Drawing Figures

APPARATUS FOR DYEING A WEB OF FABRIC CONTINUOUSLY

BACKGROUND OF THE INVENTION

The present invention relates to apparatus for continuously dyeing a web of fabric, particularly pile fabric such as carpets and moquettes. It is a self-contained type which can perform all the steps including preheating, spray dyeing, cooling, rinsing, etc.

For the dyeing of a web of fabric, there are the wince dyeing process and the continuous dyeing process. The latter was developed as a substitute for the former and has an increased productivity.

As described e.g. in the "Fabric Manual" issued by Maruzen Co., Ltd. on May 30, 1970, on pages 956–960, the conventional apparatus for continuous dyeing has separate units merely coupled with one another. These units each serve for the giving of a dye, drying, giving of chemicals, steaming, airing, reduction, dry heating, after-treatment, and rinsing. As a method for giving a dye, it is known to spray heated dye to a preheated fabric by means of spray nozzles (e.g. from Japanese patent publications Nos. 52-48222, 53-4155, 54-4434 and 56-47303 and Japanese patent laid-open publications Nos. 55-152855, 56-364 and 56-140158).

With such a conventional apparatus for continuous dyeing, heat consumption is extremely large. In order to decrease the heat consumption, it is required to minimize the volume of dye supplied to the fabric. For this purpose, various methods are known e.g. to squeeze the fabric with a mangle or to coat the fabric with dye by means of rolls. However, such methods are not satisfactory because the wider and the thicker the fabric is, the more difficult it is to squeeze or coat uniformly.

The spray method using spray nozzles is a more effective method because the adjustment of the dye pressure is easy. However, spraying a dye against the fabric on a flat conveyor (as disclosed in the abovesaid Japanese patent publications) or against a concave surface of the fabric can cause listing, frosting or ending even in a wet heat condition. The wider and the thicker the fabric is, the more marked this tendency is.

Other problems to be solved include difference in color between lots, difficulty in dyeing fine gauge fabric, and poor contrast in dyeing fabric having yarns with different dye-reactivity. Savings in dyeing time and of dye, dye-assist and water are other requirements to be met.

It is known that treating polyamide fabric with a copper salt increases light-fastness. However, treating the dyed fabric with a copper salt can smudge it with green peculiar to a copper salt. Therefore, it is usual to put a copper salt in the dye to add copper at the same time with dyeing. This also can give a bad effect on the size used and decrease the viscosity in continuous dyeing.

It is also known to after-treat the dyed fabric with an oxidation inhibitor (to increase the heat resistance) or with an ultraviolet absorbing agent (to increase the light resistance). Because of their low affinity to polyamide fabric, such chemicals have to be used in high concentration (e.g. 30–40 g/l) to obtain an expected effect. This results in a considerable loss in the subsequent drying step.

In a continuous dyeing of wool fabric, the pick-up of dye is smaller than in the wince dyeing, and steaming for heat treatment is performed only in a short time. So the felting, which often occurs in the wince dyeing due to the intertwining of scales on the surface of wool fabric, is less likely to happen. But, shorter time for heat treatment decreases the fastness to dyeing, laundering and rubbing. This tendency is marked for dark colors.

Because of its high resistance to light and heat, polyester fabric has an active demand for various goods. But, thick web of fabric is not easy to dye. Thus, it is usually yarn-dyed by the high-pressure batch process. The continuous dyeing process has not been used for this fabric because sealing at the inlet and outlet of an apparatus poses a problem. Also, as in the invention disclosed in the Japanese patent publication No. 52-25469, as the dye at normal temperature is heated in a hot steamer, water in the dye liquid will be evaporated and the fabric is gradually dried. In this step, the migration of a disperse dye used is inevitable. Disperse dyes are generally highly sensitive to heat and it is difficult to keep the whole part of thick fabric at a uniform temperature, and distribution of overheated steam is not uniform. So it is difficult to prevent the migration of disperse dye. Therefore, treatment in a hot steamer requires the use of a size.

An object of the present invention is to provide an apparatus for dyeing a web of fabric continuously, which obviates the abovesaid shortcomings.

SUMMARY OF THE INVENTIONS

In accordance with the present invention, there is provided an apparatus for dyeing a web of fabric continuously, comprising apparatus for continuously dyeing a web of fabric, particularly pile fabric, comprising: a dry heating unit for heating the fabric to a dye-reactive temperature while transferring it; a wet heating unit connected to the dry heating unit to form a complete unit for fixing a dyeing reaction; a pile separating roller provided in the dry heating unit and the wet heating unit so as to extend crosswise with respect to the fabric for bending the fabric and thus separating the piles on the fabric; and a plurality of spray means provided in the dry heating unit and the wet heating unit so as to be opposed to the pile separating roller for spraying a dye and/or chemical in a fan-shaped film into space between the piles separated by the pile separating roller.

The apparatus in accordance with the present invention makes possible continuous treatment of polyamide fabric with a copper salt and continuous dyeing of wool fabric and polyester fabric with a low pickup ($\frac{1}{4}$ to 1/10 of the pickup in the conventional continuous dyeing apparatus) and by use of a dye of lower concentration ($\frac{1}{2}$ to $\frac{1}{3}$ in comparison with the conventional one). In any case, the reaction is complete and fixed in a shorter time on the fabric treated with a dye or chemical. Also, the fabric is dyed or treated extremely uniformly. Since the preheating unit and the wet heating unit are combined together, the heat emission area is small. This minimizes the heat consumption. Also, dye, chemicals and water can be saved.

The dyeing apparatus according to the present invention can also be used for dyeing fabric woven by mixing yarns having different dyeing reactivities.

For example, polyamide fabric most often used for carpets and moquettes are made by weaving yarns dyeable with an acidic dye and yarns dyeable with a cation dye, and are dyed with a dye liquid which contains an acidic dye, a cation dye, a suspension stabilizer for preventing suspension due to cohesion of different ions, a leveling agent and a dye-assist agent. Upon reaction with a dye liquid at a high temperature, different dye particles will fix in dye seats of respective yarns, so that a multicolor pattern will appear.

Other objects and features of the present invention will become apparent from the following description taken with reference to the accompanying drawings, in which:

DETAILED DESCRIPTION OF THE INVENTION

As for the dry heating unit for heating the fabric to a dye-reactive temperature while it is moved, no limitation is put on the shape, heating method and fabric transfer method. However, in order to save the space and heat consumed, the fabric should preferably be moved from bottom to top and be heated by blowing hot air or overheated (not condensed) air heated by a heater provided in the unit against both surfaces of the fabric.

The wet heating unit heats the dye-sprayed fabric with steam to insure the progress and retention of the interaction between the dye-sprayed fabric and the dye and/or chemicals. Thus the temperature and humidity have to be adjusted according to the kind of the fabric, dye and chemicals used. The steam used may be saturated steam or overheated steam. The wet heating unit is partitioned from the dry heating unit by a wall having a slit of a sufficient size to allow the fabric to pass.

The pile separating roller is adapted to press the fabric on its back side to bend the fabric lengthwise, thus separating (or opening) the piles crosswise.

Figure 4:
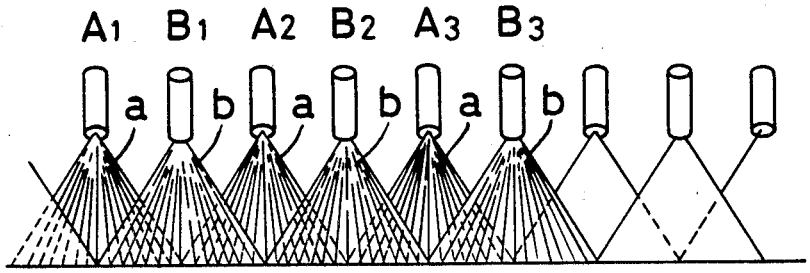
FIG. 4 is a front view of the spray guns and dye films formed thereby.

Both the dry heating unit and the wet heating unit are each provided with at least one set of spray guns to spray dye into each linear space between the separated piles. The dye films formed by the spray guns are fan-like shaped as viewed in the direction of width (FIG. 4). These units may be provided with auxiliary spray guns.

The wet heating unit must have such a shape and size as to allow the fabric to be bent at least once in it. It should contain a saturated or overheated steam generator and a heater. They may be provided outside of the unit and connected to it. But, they should preferably be provided inside to save energy.

The apparatus in accordance with the present invention has a dry heating unit and a wet heating unit both at a normal pressure. They are combined into one unit. In the dry heating unit, the fabric is heated to a temperature suitable for the dyeing reaction. For heating a piled fabric such as carpets, heating by hot-air jet is preferable.

Upon contact of a preheated dye with the fabric thus heated in a heated atmosphere, the dyeing reaction will start immediately and progress smoothly without any temperature drop. The reaction speed is high and the reaction will end in a short time. If the calorie the heated dye has is insufficient, heat may be supplemented in the wet heating unit. The temperature in the dry heating unit and the humidity and temperature in the wet heating unit and the fabric moving speed should be adjusted according to the type of fabric and dye.

With the dye spray method of the present invention in which a dye is sprayed from spray guns arranged in two lines at different angles into space between the piles separated by the pile separating roller, a small amount of dye is sufficient to dye the piles from their tip to root. Chemicals instead of dyes can be sprayed in the same manner. The arrangement of the spray guns in accordance with the present invention allows two or more kinds of dyes or dye and chemical to be sprayed in different dyeing conditions. The number of spray guns used among all the guns provided should be adjustable to adjust the dyeing width according to the width of fabric. If the wet heating unit is not needed, it may be used as a slow cooling space for recrystallization of high polymer molecules of the heat-treated fabric.

Next, the dyeing of a fabric containing two or more kinds of yarns having different dyeing reactivities will be described below. A first dye liquid preheated to a dye-reactive temperature is sprayed to the fabric preheated to a suitable temperature (e.g. 90°-100° C.). The first dye liquid contains a dye (e.g. a cation dye), a dye solvent, an acid and a swelling agent. Immediately after spraying, the dyeing reaction between the dye and the yarns dyeable with the cation dye will start and progress with a considerable speed. This dyeing reaction will be settled in the next station in a wet heat atmosphere. Next, a second dye liquid containing another dye (e.g. an acidic dye), an acid and a suspension agent is preheated to the dye-reactive temperature for the acidic dye and is sprayed against the fabric in a wet heat atmosphere. The reaction between the acidic dye and the yarns dyeable with the acidic dye, too, will progress rapidly, but in different sites. This means that two different dyeing reactions end in a short time.

In dyeing polyamide fabric woven by mixing yarns dyeable with a cation dye and yarns dyeable with an acidic dye, for example, the cation dye in the first dye liquid is received on the yarns dyeable with the cation dye, but merely gets on the yarns dyeable with the acidic dye because the cation dye is charged positively whereas amino radicals in the polyamide fiber, which can be seats for the acidic dye, are charged positively. The reception of the cation dye is made positive by heating the fabric in a wet heat atmosphere. When the second dye liquid is sprayed onto the fabric in a wet heat atmosphere, the acidic dye charged negatively reacts instantaneously with the positively charged radicals on the yarns dyeable with an acidic dye. The acidic dye is fixed as the fabric moves in a wet heat atmosphere. The unreacted cation dye on the yarns dyeable with an acidic dye will be rejected or driven by the acidic dye and be removed during rinsing which is the last step. Similarly, unreacted acidic dye merely attaching to the yarns dyeable with a cation dye will be removed in the rinsing step.

Although the present invention has been described mainly with reference to polyamide fabric, the apparatus in accordance with the present invention is applicable to nylon/acryl mixed fabric, tetron/cotton blended fabric, and union fabric. In the wet heat zone, saturated steam or overheated steam may be used depending on the application.

As for the water seal tank for water sealing and rinsing, the temperature should be adjusted to cool the fabric slowly not to impair the feeling of the product, that is, piled fabric.

The present invention will be further described with reference to the Examples, which do not mean to limit the present invention in any way.

EXAMPLE 1

Figure 1:
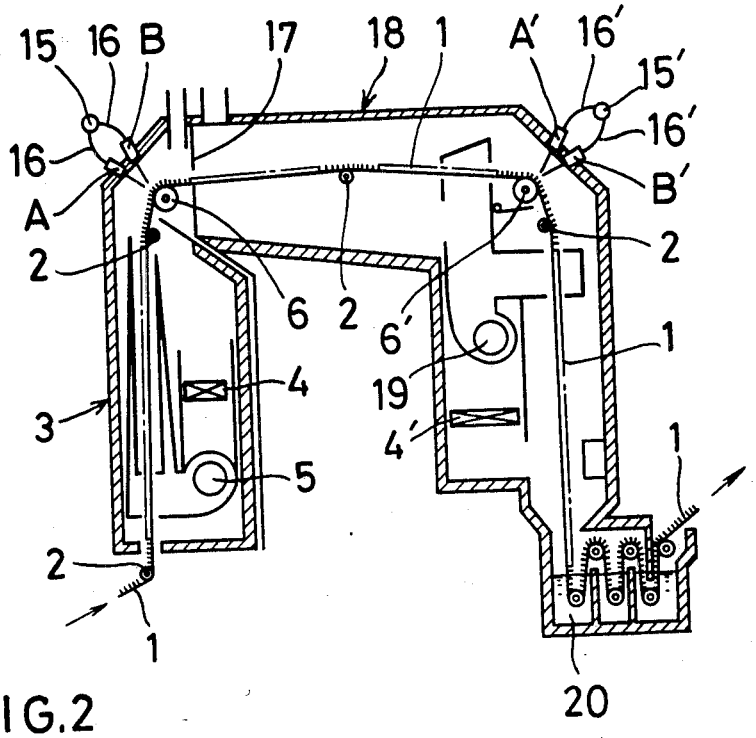
FIG. 1 is a vertical sectional view of the apparatus embodying the present invention.

In FIG. 1, a web of fabric 1 enters a dry heating unit 3, guided by guide rollers 2 suitably arranged. The dry heating unit 3 heats the whole surface of the fabric 1 up to the dye-reactive temperature by means of air heated by a heater 4 and blown by a fan 5. Sharp heating and partial heating should be avoided because it might change the structure of the textile and too high a temperature causing oxidation could impair the feeling of the fabric. The use of an inert gas such as nitrogen instead of air should be considered. Since the apparatus used in the present invention is at a normal temperature, no special measure is needed to withstand the pressure at the inlet and outlet of the dry heating unit 3.

Figure 3:
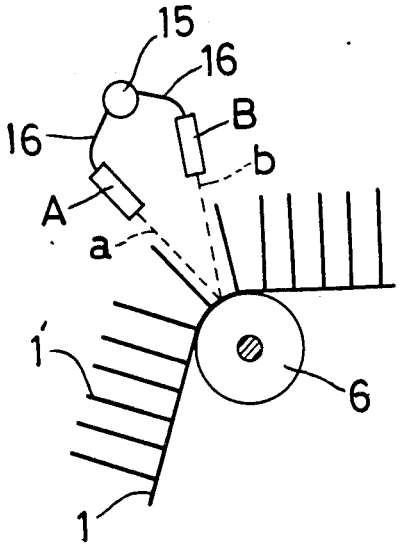
FIG. 3 is an enlarged side view showing the arrangement of the spray guns.

The fabric now at the dye-reactive temperature is bent lengthwise by means of a pile separating roller 6 arranged crosswise. The larger the bending angle, the larger the effect of separating the pile is. The angle should be 60–135 degrees at outside (45–120 degrees at inside). The pile separating roller 6 should be set substantially horizontally and the fabric should be guided to run substantially horizontally after leaving the roller 6, to avoid the displacement of the fabric and the offset of the sprayed dye. The piles 1' on the fabric 1 are separated by the pile separating roller 6 as shown in FIG. 3. Dye is sprayed into between the piles 1' from a plurality of pairs of spray guns.

Figure 5:
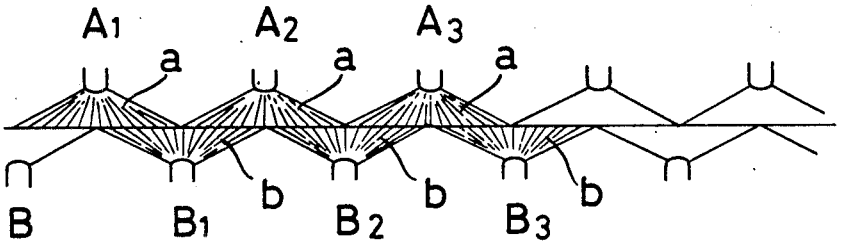
FIG. 5 is a plan view of the spray guns and dye films formed thereby.

The spray guns $A_1$, $A_2$, $A_3$, . . . and $B_1$, $B_2$, $B_3$, . . . constituting the groups A and B, respectively, are so arranged as shown in FIGS. 4 and 5 that the dye films a and b formed by the groups A and B, respectively, will overlap each other. The spray guns or nozzles should be made of a material having a good resistance to heat and chemical. The angle between the spray guns A and B and the distance between the spray guns and the fabric should be adjustable according to the properties of the fabric to be dyed (such as the kind of material and the length of piles).

Figure 2:
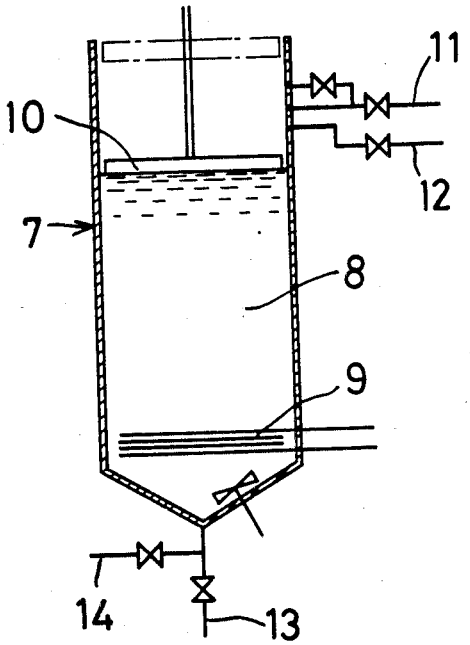
FIG. 2 is a vertical sectional view of the dye tank used with the apparatus.

In order to keep constant the sizes of the dye films a and b, a pressure reducing valve and a back pressure valve should be provided at each end of a pipe header 15 (FIG. 3) to keep constant the discharge pressure and thus the discharge volume of the dye. Also, a dye tank 7 as shown in FIG. 2 may be provided. It is made of a material having a good resistance to chemical, and has a heater 9 which can heat the dye liquid 8 to the dye-reactive temperature, and a vertically adjustable lid 10 which covers the dye without leaving any space thereover to prevent the heat dissipation and the change in concentration due to water evaporation. The heater 9 should be used to heat the dye and to keep it at a constant temperature.

Conveniently a hot water inlet 11 should be provided to sprinkle water into the tank with the lid at its topmost position shown with a dotted line to wash the inside of the tank after the replacement of dye. In the tank 7, a dye-assist agent or any other chemical instead of dye may be storaged. The tank 7 is provided with a supply pipe 12, a discharge pipe 13 and a feed pipe 14. The dye 8 or other chemical is supplied through the pipe 14, the pipe header 15 and the flexible hoses 16 to the groups A and B of spray gun.

In the present invention, the dye is sprayed without using compressed air to avoid the waste of dye due to scattering. Therefore, the distance from the dye tank 7 to the pipe header 15 (or 15') should be as short as possible and the tank 7 and all the pipe lines should be heated to prevent the dye from cooling. Also, heaters should be provided near the spray guns for final adjustment of the dye temperature.

In order to keep constant the pressure of spraying from the spray guns, pressure switches (not shown) should be provided to adjust manually or automatically the liquid pressure in the pipe header to about 50–100 $kg/cm^2$. A selective use of any desired ones of the spray guns is possible by using solenoid valves and controlling by a computer. If it is desired to prevent the formation of stripes or spots, the spray guns should be shaked in a crosswise direction. The volume of dye sprayed per unit time may be adjusted by providing auxiliary sprays in addition to the spray guns or changing the size of the spray guns.

The dye-sprayed fabric 1 passes through a slit in a wall 17 and enters a wet heating unit 18 where it is subjected to high humidity and high temperature. Steam may be produced inside or outside the unit 18. The unit should have a heater 4' and a fan 19 for agitating the steam. The wet heating unit 18 should be adjusted to optimal humidity and temperature for the kind of fabric 1, the size of piles and the kind and volume of dye 8 to give a sufficient calorie to compensate for the drop of the temperature of the dye film due to the water evaporation so that the chemical reaction for dyeing will start upon the collision of the dye film against the fabric and its piles. Saturated steam or overheated steam may be used as the water vapor. If the water content and the calorie of the dye are sufficient, the supply of steam may be stopped and the entire unit 18 be put in a slow cooling atmosphere.

At a suitable position of the wet heating unit 18, the second pile separating roller 6' is provided to bend the fabric 1 again. The second set of spray guns comprising groups A' and B' is provided to spray a dye or chemical into between the separated piles. After the sprayed dye or chemical has been fixed, the fabric passes through a water seal tank 20 for rinsing and is taken out of the system. Because rapid cooling of the fabric heated to a high temperature can leave strain or distorsion in the fabric structure, a plurality of water seal tanks may be provided for slow cooling. It is desirable that the fabric is taken out only after it has been cooled to about 40°–60° C. The fabric is then passed to a dehydration station. In this embodiment, the dry heating unit 3, wet heating unit 18 and dye tank 7 are completely covered by a heat insulation material.

EXAMPLE 2

A web of polyamide carpet (mass of pile per unit area: 500 $g/m^2$, 200 cm wide, 12 mm thick) was dyed and treated under the following conditions by use of the continuous dyeing apparatus described in Example 1.

(1) Dry heating unit: 95±2° C.

(2) First spray gun group

| Dye composition |
|---|
| 1:2 metallized dye (made by Ciba-Geigy) |
| Irgalan black RBL 200% |

-continued

| | |
|---|---|
| Irgalan yellow 2BRL<br>Irgalan red brown RL | 0.3 g/l |
| Light resistance improver containing copper (Nikka Chemical Kogyosha: SN-500) | 0.1–0.5 g/l |
| Level dyeing agent (polyoxyethylenenonylphenylether) | 1–2 g/l |
| Acetic acid | pH 4 |
| Dye temperature | 95 ± 1° C. |
| Spray pressure | 50 kg/cm$^2$ gauge |
| Dye pickup | 250% by weight |

(3) Second spray gun group

| Treatment composition | |
|---|---|
| Heat resistance improver (Meisei Chemical Kogyosha: Antifade 3000) | 10–20 g/l |
| Temperature of treatment | 95 ± 1° C. |
| Spray pressure | 50 kg/cm$^2$ gauge |
| Pickup | 100% by weight |

With a conventional continuous dyeing apparatus, the pickup of dye or chemical was 1,000–1,500%. With the apparatus according to the present invention, it was found that a pickup of 250% was sufficient to achieve the aimed purpose and to cause the light resistance improver and the heat resistance improver to be adsorbed effectively.

For the second spray gun group, instead of the above-said heat resistance improver a water repellent (Nikka Chemical Kogyosha: NK guard FG 255), a softening agent (Nikka Chemical Kogyosha: NIKKA silicone EP-1000), an antimicrobial agent (Nikka Chemical Kogyosha: F-3290), an antistatic agent (Nikka Chemical Kogyosha: Nicepole FF-18), and a flameproofing agent (Nikka Chemical Kogyosha: Nikka Finon PAS-64) were used to treat the fabric. Extremely good results were obtained in any case.

EXAMPLE 3

By use of the apparatus of the present invention, fabric for wool tufted carpet (mass of pile per unit area: 900 g/m$^2$, 380 cm wide, 8 mm thick, 200 m long) was dyed after it has been subjected to non-shrink treatment to a minimum degree.

Conditions for non-shrink treatment

| | |
|---|---|
| (1) Wetting agent (Nekalin LN made by BASF) | 0.2% |
| $Na_2SO_4$ | 10% |
| Acetic acid | pH 5–6 |
| Treatment | 30° C., 10 min |
| (2) Organic chlorine compound (Basolan DC made by BASF) | 1.5%–3.0% |
| Treatment | 20–30° C., 30 min |
| (3) Dechlorinating treatment | |
| Acid sodium sulfite | (2–3%) |
| Treatment | 40° C., 30 min |
| Dry heating unit | 95 ± 2° C. |
| First spray gun group | |
| Dye composition | |
| Wool-reactive dye (Ciba-Geigy) | |
| Lanasol blue 3G<br>Lanasol yellow 4G<br>Lanasol red 6G | 2.5 g/l |
| Swelling agent (Benzyl alcohol) | 5 g/l |
| Formic acid | pH 1–2 |
| Level dyeing agent (Polyoxyethylene-nonylphenylethel) | 2 g/l |
| Temperature of dye liquid | 95 ± 1° C. |
| Spray pressure | 50 kg/cm$^2$ gauge |

-continued

| | |
|---|---|
| Dye pickup | 250% |
| Steaming in the wet heating unit | 30–60 sec |

The wool tufted carpet dyed under the abovementioned conditions was uniformly dyed in an extremely short time with evenness and without felting. Acidic dyes and 1:2 metallized dyes were usable as well as wool-reactive dyes with good dye-fastness.

EXAMPLE 4

A web of polyester carpet (mass of pile per unit area: 500 g/m$^2$, 200 cm wide, 12 mm thick, 200 m long) was dyed with the apparatus of this invention.

| | |
|---|---|
| (1) Dry heating unit | 180 ± 2° C. |
| (2) First spray gun group | |
| Composition of dye liquid | |
| Disperse dye (made by Nagase Sangyo) | |
| ND AUTO yellow No. 1<br>ND AUTO red S-308<br>ND AUTO blue No. 1 | 30 g/l |
| Carrier (Teryl carrier H-2 made by Meisei Chemical Kogyosha) | 3 g/l |
| Carrier (Adocol ESP made by Meisei Chemical Kogyosha) | 3 g/l |
| Level dyeing agent (Nikka sansolt RM-300 made by Nikka Chemical) | 2 g/l |
| Light resistance improver (CIBATEX LF made by Ciba Geigy) | 20 g/l |
| Acetic acid | pH 4–5 |
| Temperature of dye liquid | 95–100° C. |
| Spray pressure | 50 kg/cm$^2$ gauge |
| Dye pickup | 80–150% |
| (3) Steaming in wet heating unit | 180 ± 2° C., 10 min |

Polyester carpet was dyed under these conditions. Blowing a dye liquid at 95°–100° C. against the fabric preheated to the dye-reactive temperature insures that the adsorption, diffusion and anchorage of the disperse dye progress positively with a very low dye pickup. The subsequent steaming at high temperature completes the dyeing reaction. Dyeing ended with high eveness in a short time with no migration of disperse dye occuring. The light resistance improver was sprayed from the second spray gun group (not added to the dye) in the same manner as with the dye. The result was good.

EXAMPLE 5

Nylon 100% union fabric [made by Dupon in USA, mass of pile per unit area: 0.64 kg/m$^2$, 854 (cation dyeable yarn)×3p, 855 (pale)×3p, 857 (deep)×3p] 1225d/3p was continuously dyed with the apparatus of the present invention.

| | |
|---|---|
| (1) Fabric heating temperature | 95 ± 2° C. |
| (2) First dye liquid | |
| Composition | |
| Cation dye (Bayer in West Germany) | 2.0 g/l |
| Astrazon blue 5GL<br>Astrazon yellow 8GSL<br>Astrazon red BBL | |
| Dye solvent (paratoluenesulphoneamid-ethyleneoxide) | 2 g/l |
| Acetic acid | pH 4–5 |
| Swelling agent (phenolethyleneoxide) | 5 g/l |
| Temperature of dye liquid | 95 ± 1° C. |
| Spray pressure | 50 kg/cm$^2$ gauge |
| Dye pickup | 200% by weight |
| Steaming (with 100% saturated steam) | 15 seconds |
| (3) Second dye liquid | |

-continued

| | |
|---|---|
| Composition | |
| Leveling dye (by Ciba-Geigy) | 2.0 g/l |
| Tectilon blue 4R | |
| Tectilon yellow R | |
| Tectilon red 2B | |
| Acetic acid | pH 3–4 |
| Suspension agent (Nikka Chemical Kogyosha, Neotex CD-100) | 10 g/l |
| Temperature of dye liquid | 100 ± 1° C. |
| Spray pressure | 50 kg/cm$^2$ gauge |
| Dye pickup | 200% |
| Steaming (with saturated steam at 100° C.) | 15 seconds |

The fabric dyed under the abovesaid conditions showed a much lower pickup in comparison with the fabric dyed with the conventional continuous dyeing apparatus (with which the pickup was about 1,000–1,500%). Yet the color contrast and dyeing fastness were very good.

What is claimed is:

1. Apparatus for continuously dyeing a web of fabric, particularly pile fabric, comprising:

a dry heating unit for heating the fabric to a dye-reactive temperature while transferring it;

a wet heating unit connected to said dry heating unit to form a complete unit for fixing a dyeing reaction;

a pile separating roller provided in said dry heating unit and said wet heating unit so as to extend crosswise with respect to the fabric for bending the fabric and thus separating the piles on the fabric; and a plurality of spray means provided in said dry heating unit and said wet heating unit so as to be opposed to said pile separating roller for spraying a dye and/or chemical in a fan-shaped film into space between the piles separated by said pile separating roller.

2. The apparatus as claimed in claim 1, wherein said spray means comprise spray guns arranged in a plurality of lines parallel to each other so as for their angle with respect to the fabric to be adjustable.

* * * * *